United States Patent [19]

Schindel

[11] 4,309,859

[45] Jan. 12, 1982

[54] COLLET HEAD AT A SEALING MACHINE

[76] Inventor: Hugo Schindel, Obersaulheimer Str. 64, 6501 Saulheim 1, Fed. Rep. of Germany

[21] Appl. No.: 86,660

[22] Filed: Oct. 22, 1979

[30] Foreign Application Priority Data

Oct. 27, 1978 [DE] Fed. Rep. of Germany ..... 2846846

[51] Int. Cl.[3] ..... B67B 3/20; B65B 7/28

[52] U.S. Cl. ..... 53/331.5; 53/348; 53/361

[58] Field of Search ..... 53/331.5, 317, 348, 53/361, 357, 353, 346, 347; 269/22

[56] References Cited

U.S. PATENT DOCUMENTS

| | | | |
|---|---|---|---|
| 13,851 | 12/1914 | Brinkman | 53/348 X |
| 2,082,048 | 6/1937 | Everett | 53/317 X |
| 2,160,992 | 6/1939 | Thomas | 53/353 X |
| 2,320,515 | 6/1943 | Engle | 53/361 |
| 2,642,213 | 6/1953 | Goldsmith | 53/357 X |
| 2,884,751 | 5/1959 | Bjering | 53/317 |
| 2,891,366 | 6/1959 | Stover | 53/361 |
| 3,955,341 | 5/1976 | Wilhere | 53/331.5 |
| 4,222,214 | 9/1980 | Schultz et al. | 53/348 X |

FOREIGN PATENT DOCUMENTS

| | | | |
|---|---|---|---|
| 78942 | 3/1932 | Sweden | 53/361 |

*Primary Examiner*—Horace M. Culver
*Attorney, Agent, or Firm*—Kinzer, Plyer, Dorn & McEachran

[57] ABSTRACT

A collet head at a sealing machine which includes a bushing having a gripper for accommodating a seal, characterized by a flexible diaphragm radially compressible by pressure fluid to apply contractible forces to a segmented gripper jaw.

4 Claims, 4 Drawing Figures

COLLET HEAD AT A SEALING MACHINE

The invention relates to a collet head at a sealing machine for the accommodation of seals particularly threaded seals at containers, said collet head comprising a bushing which is open toward the exterior, accommodating the seal, with a gripper member being inserted into said bushing.

A collet head is known from prior art within the scope of such a filling and sealing machine, said collet head being of bushing-like design with the lock held firmly in said bushing, being placed on the container and being screwed on with torque. In this embodiment according to prior art the head is adjusted to the shape and size of the lock, with resilient gripping means being inserted on the interior side. In this respect it is disadvantageous that a corresponding head must be available for each form of lock, and this represents a tremendous investment for the many shapes and sizes of such locks. The locks, mostly fabricated from synthetic material, differ in their dimensions within the scope of the admissible tolerances, so that it may occur that individual sealing caps are maintained insufficiently in the head and the necessary screw-on torque cannot be transmitted. Moreover, the disadvantage exists that with sensitive locks damages occur due to friction. This is especially so if on account of insufficient holding in the head the supporting spindles, rotating at a higher number of revolutions, cause the seal merely to on the lock. Moreover, a collet head is also known where a rubber ring is clamped axially into the casing and compressed axially by a piston, so that this rubber ring bulges out radially.

This embodiment is likewise afflicted with considerable disadvantages. The rubber ring must be particularly elastic in order to attain reasonable responsiveness to the pressure piston. However, this also results in particularly high susceptibility to abrasion, so that the holding member must be replaced frequently. The pressure piston related to the spindle must be sealed appropriately for the pressure medium. A relatively high pressure is required for mustering the axial force, in order to achieve the desired radial expansion of the rubber member, with the result that the seals, taxed very highly, become leaky and pressure medium flows out. Because of this relatively high pressure the deaerating time is relatively long and high air noises also are generated. A disadvantage also exists in that the seals are not always accommodated in the head with accurate centering.

The invention is based on the problem of so designing such a collet head that the seals are slideproof, are centered accurately independently of changes in size, and also that they can be screwed to the container without sustaining damage.

According to the invention this problem is solved by arranging in the casing as the gripping member a flexible diaphragm which is radially inwardly extendible with the aid of a pressure medium.

One advantageous embodiment is characterized by the fact that the diaphragm is approximately of U-shape in its cross section and guided on the annular front edge of the casing, whereby a covering cap sealingly clamps the diaphragm the front edge.

It furthermore is advantageous to apply spacer ribs for the passage of the pressure medium at the rear side of the diaphragm toward the bottom surface, as well as radially toward the annular surface of the diaphragm.

Another advantageous embodiment provides that a rubber ring is inserted into the casing, in engagement with the diaphragm.

It furthermore is advantageous to fasten segmental holding jaws in the casing, within the diaphragm area, said jaws being displaceable radially inward to vary the gripping opening.

In this respect it is advantageous to arrange pressure springs between the segmental holding jaws.

Finally the segmental holding jaws should have a narrow edge protruding over the casing.

The invention offers the important advantage that the seals accommodated in the head, centered accurately, can be placed on the container and be screwed on with the necessary torque. Thereby the seals are held securely until the adjusted torque is reached, whereby damages are to be ruled out. Major manufacturing tolerances of the seals are balanced, whereby also a simple adjustment to different seal sizes can be accomplished by replacing a rubber ring arranged in the interior. Another important advantage resides in the fact that a simple gripping is possible by the diaphragm itself. Thereby it is possible to operate with low pressures. The collet head according to the invention furthermore distinguishes itself by its particularly simple design. In the embodiment with the segmental holding jaws the additional advantage is achieved that the seals can even be applied when the containers are placed tightly against each other or if on account of the shape only a small space is present between the containers in the area of the seal. This embodiment also makes one independent of the contents of the container because the jaws may be made of a material which is resistant against the contents of the container. With locks with complicated outer contours the jaws can be inserted into the collet head as molded body.

The invention will be elucidated in greater detail in the following specification, by way of embodiments exemplified in the drawings.

Figure 1:
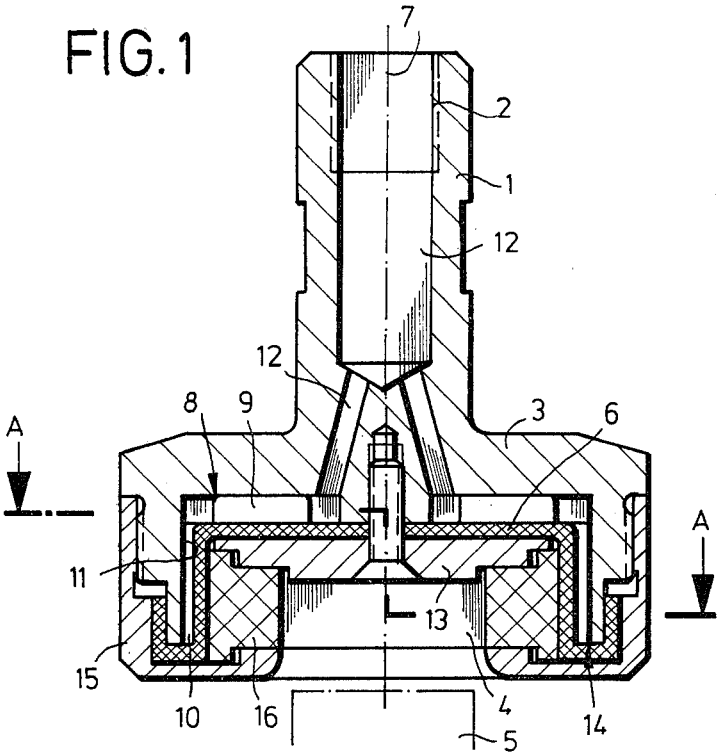
FIG. 1 shows a first embodiment of such a collet head in longitudinal section.
Figure 3:
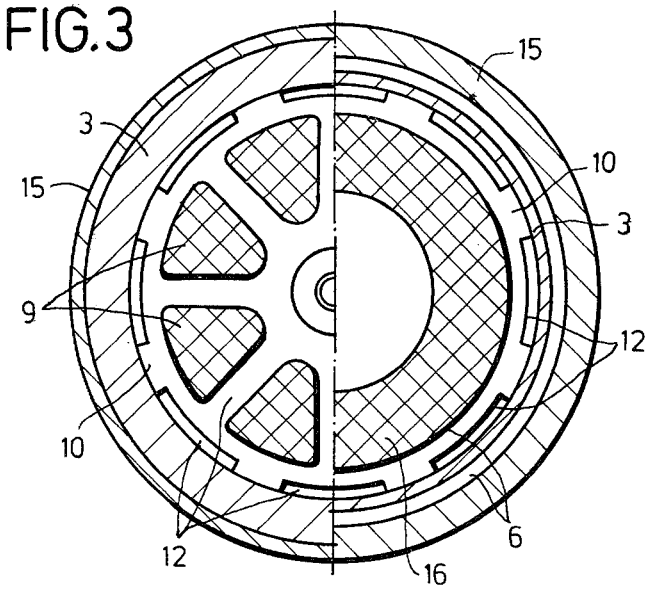
FIG. 3 shows a cross section along line A—A in FIG. 1.

In the embodiment represented in FIGS. 1 and 3 a collet head 1 is screwed with a thread 2 to the sealing machine. The head 1 thereby is provided with a bushing or casing 3 which in the embodiment shown is of cylindrical design. A seal 5, shown in dots and dashes in the drawing, is received in the cavity 4 formed by the casing 3.

A diaphragm 6 having spacer ribs 9 and/or 10 facing toward the inner bottom surface 8 of the casing 3, and to the inner annular surface 11 of this casing 3, is mounted in this casing 3, so that the pressure medium can ingress via a passage 12. Moreover, an accurate centering of the diaphram 6 is assured thereby. The fastening of the diaphragm to the head 1 is accomplished with the aid of a disk 13 covering the entire bottom surface of the diaphragm 6. The diaphragm 6 is guided U-like about the frontal side 14 of the casing 3 and secured with the aid of a locknut 15 which is threaded to the casing 3 and sealed tightly. A rubber ring 16 which is maintained by the locknut 15 also is inserted in the interior of the area 4 to which the diaphragm 6 adheres.

To seize the seal 5, pressure medium flows via the passage 12 into the lateral area formed between the ribs 10, whereby the ring 16 is urged inwardly, radially toward the axes 7, whereby the seal 5 is held firmly accordingly. Thereby the ring 16 is urged inwardly uniformly about its entire circumference so that the entirety of the ring 16 comes to bear on the circumference of the seal. By bleeding the conduit 12 the seal 5 is released again.

Figure 2:
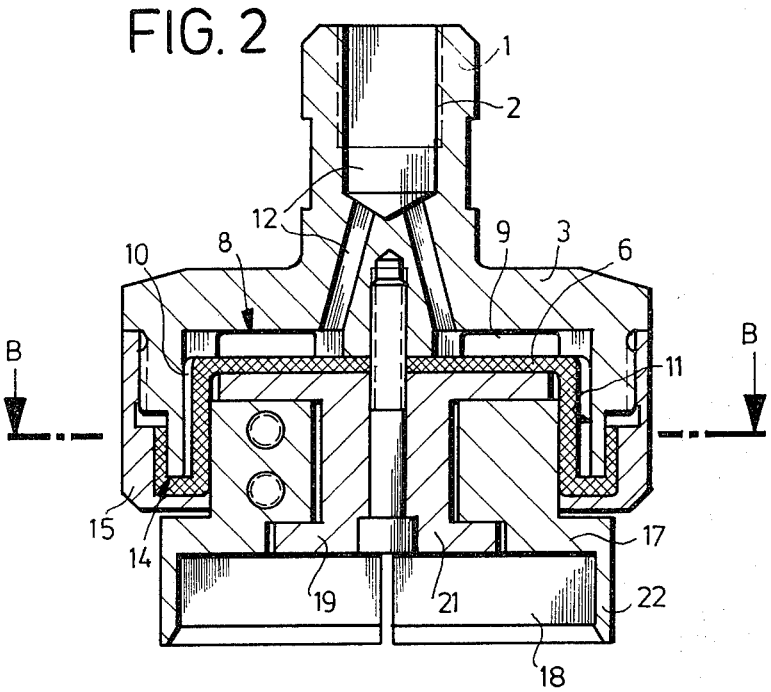
FIG. 2 shows a second embodiment of the head in longitudinal section.
Figure 4:
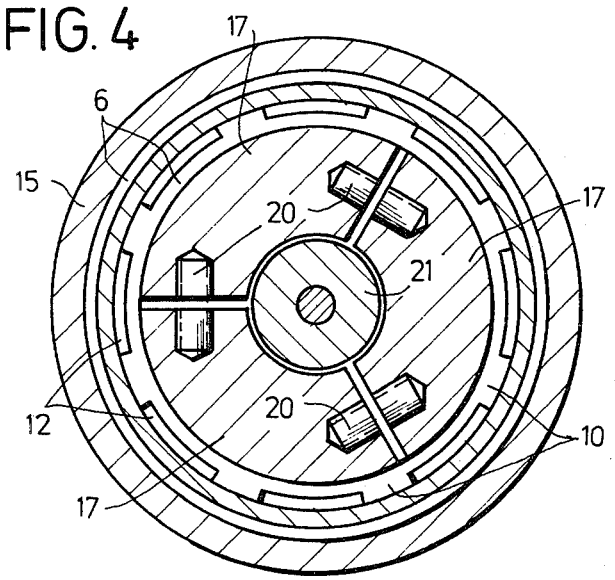
FIG. 4 shows a section along line B—B in FIG. 2.

FIGS. 2 and 4 show another embodiment of such a collet head, whereby identical parts are provided with the same numerals as in the embodiment exemplified in FIG. 1. Under this embodiment segmental holding jaws 17 are arranged within the area 4 and secured to the casing 3 with the aid of a stud 19, while clamping the diaphragm 6. The stud 19 is of I-shape design in cross section, whereby in the area of the central constriction 21 the individual jaws 17 are guided for radial displacement when contracted by the diaphragm 6. These holding jaws are formed to present at the inside a gripping aperture 18 which is presented by a narrow annular rim 22.

It is indicated in FIG. 4 that pressure springs 20 which urge the individual holding jaws 17 into the expanded, open or released position are arranged between said individual holding jaws 17. These springs may be dispensed with if the spindles (not shown) operate at higher numbers of revolutions whereby the jaws are urged outwardly to the open position by the centrifugal forces which are generated.

What is claimed is:

1. A collet head for a sealing machine for the accommodation of seals, particularly threaded seals for containers, said collet head comprising a bushing having an open end toward the exterior, accommodating the seal, characterized by a flexible diaphragm (6) arranged in the bushing (3) and contractible radially inward with the aid of a pressure medium, a contractible gripping member inserted into the open end of the bushing, said gripping member having a circumference engageable with the diaphragm so as to be radially contractible upon radial contraction of the diaphragm, said gripping member comprising jaws or segments (17) circumferentially displaceable to vary the grip opening thereof, and said jaws each being provided with an edge or foot (22) extending beyond the open end of the bushing, and means positioned in the open end of the bushing presenting guiding surfaces which capture and guide the gripping member.

2. The collet head as defined in claim 1, characterized by the fact that the diaphgram (6) is approximately U-shaped in its cross section and guided about the front edge (14) of the bushing (3) annularlike whereby a covering cap (15) sealingly clamps the diaphragm (15) at the front edge (14).

3. The collet head as defined in claims 1 or 2, characterized by the application of spacer ribs (9,10) for the passage of the pressure medium at the rear side of the diaphragm (6) toward the bottom surface (8) as well as radially toward the annular surface (11) of the diaphgram (6).

4. The collet head as defined in claim 1, characterized by arranging pressure springs (2) between the holding jaws (17).

* * * * *